US010077943B2

(12) United States Patent
Song

(10) Patent No.: US 10,077,943 B2
(45) Date of Patent: Sep. 18, 2018

(54) ENHANCING PERFORMANCE OF AIR SOURCE HEAT PUMP SYSTEMS

(71) Applicant: SaeHeum Song, Skillman, NJ (US)

(72) Inventor: SaeHeum Song, Skillman, NJ (US)

( * ) Notice: Subject to any disclaimer, the term of this patent is extended or adjusted under 35 U.S.C. 154(b) by 18 days.

(21) Appl. No.: 15/089,697

(22) Filed: Apr. 4, 2016

(65) Prior Publication Data

US 2016/0290726 A1 Oct. 6, 2016

Related U.S. Application Data

(60) Provisional application No. 62/143,166, filed on Apr. 5, 2015.

(51) Int. Cl.

| | |
|---|---|
| ***F25B 7/00*** | (2006.01) |
| ***F28D 1/02*** | (2006.01) |
| ***F25B 47/00*** | (2006.01) |
| ***F28F 3/02*** | (2006.01) |
| ***F28D 1/047*** | (2006.01) |
| ***F25B 5/04*** | (2006.01) |
| ***F25B 39/02*** | (2006.01) |

(52) U.S. Cl.

CPC ..... *F28D 1/0206* (2013.01); *F25B 5/04* (2013.01); *F25B 39/02* (2013.01); *F25B 47/006* (2013.01); *F28D 1/0477* (2013.01); *F28F 3/02* (2013.01)

(58) Field of Classification Search

CPC ..... F28D 1/0206; F28D 20/0034; F28D 2020/0078; F28F 9/0234; H05K 7/2029; H01L 23/467; H01L 23/1473; F25B 39/02; F25B 5/04; F25B 47/006

USPC ..... 62/79

See application file for complete search history.

(56) References Cited

U.S. PATENT DOCUMENTS

| | | | | |
|---|---|---|---|---|
| 2,515,825 | A * | 7/1950 | Grant | F25B 5/04 137/903 |
| 4,333,520 | A * | 6/1982 | Yanadori | F24F 12/002 165/104.21 |
| 2010/0257890 | A1* | 10/2010 | Murakami | B60H 1/00492 62/430 |
| 2011/0067437 | A1 | 3/2011 | Song | |
| 2014/0223945 | A1* | 8/2014 | Rahl | F25B 27/005 62/235.1 |

* cited by examiner

*Primary Examiner* — Frantz Jules
*Assistant Examiner* — Steve Tanebaum
(74) *Attorney, Agent, or Firm* — Arthur Jacob

(57) ABSTRACT

A booster unit and method increase the performance of an air source heat pump system at low ambient air temperatures, the air source heat pump system including a conduit system for forwarding a refrigerant through an external circuit exposed to ambient air. A tubular system is immersed in a liquid heat exchange medium, such as water or antifreeze, within a booster chamber having chamber walls exposure to ambient air. An internal circuit of the tubular system receives refrigerant from the conduit system for advancement through the tubular system and delivery back to the conduit system so that heat passing from ambient air through the chamber walls and into the liquid heat exchange medium in the booster chamber is transferred from the liquid heat exchange medium to the refrigerant in the tubular system, to increase the temperature of the refrigerant being delivered from the tubular system and forwarded to the external circuit, thereby reducing or eliminating frosting at the external circuit.

20 Claims, 6 Drawing Sheets

ENHANCING PERFORMANCE OF AIR SOURCE HEAT PUMP SYSTEMS

This application claims the benefit of U.S. Provisional Patent Application Ser. No. 62/143,166, filed Apr. 5, 2015, the subject matter of which is incorporated herein by reference thereto.

The present invention relates generally to air source heat pump systems and pertains, more specifically, to apparatus and method for increasing the performance of air source heat pump systems operating at low ambient air temperatures.

Air source heat pump systems have been found to provide exemplary performance coupled with convenient and low cost installation in a wide variety of heating and cooling applications. However, the use of air source heat pump systems has been limited due to the need for frequent defrosting when operated at low ambient temperatures. Frosting will occur when the surface temperature of the materials employed in various components of the air source heat pump system falls below the dew point and the freezing temperature of the moisture in the ambient air in which the system is operating. While it may be possible to increase the superheat temperature of the refrigerant employed in the system to thereby increase the outside surface temperature of the conduits that carry the refrigerant, thus minimizing the need for defrosting and gaining increased performance, such a procedure would require an additional source of heat beyond that ordinarily available in ambient air.

Water source heat pump systems make use of heat available in such natural sources as rivers, lakes and groundwater and operate with a high degree of efficiency, as compared to air source heat pump systems. The present invention recognizes the effectiveness in the use of a liquid heat exchange medium, such as water, in a heat pump system in order to gain higher efficiency, as demonstrated by water source heat pump systems, and takes advantage of that higher efficiency to minimize the need for defrosting in an air source heat pump system. Thus, the present invention provides a system and method by which heat is transferred from ambient air to a liquid heat exchange medium, such as water or antifreeze, and then between the liquid heat exchange medium and a refrigerant in the air source heat pump system, thereby attaining increased efficiency and effectiveness through reducing the need for defrosting in the air source heat pump system.

The above objects and advantages are attained by the present invention which may be described briefly as a booster unit for increasing the performance of an air source heat pump system at low ambient air temperatures, the air source heat pump system including a conduit system for forwarding a refrigerant through an external circuit exposed to ambient air, the booster unit comprising: a booster chamber having chamber walls for exposure to ambient air, the chamber walls comprising thin plates of highly heat conductive material enclosing a chamber volume for containing a liquid heat exchange medium; and a tubular system placed within the booster chamber for being immersed in liquid heat exchange medium contained within the booster chamber, the tubular system including an internal circuit having an inlet for receiving refrigerant from the conduit system and an outlet for delivering to the conduit system refrigerant received at the inlet and advanced to the outlet; whereby heat passing from ambient air through the chamber walls and into the liquid heat exchange medium in the booster chamber will be transferred from the liquid heat exchange medium to the refrigerant in the tubular system, to increase the temperature of the refrigerant being delivered to the conduit system and forwarded to the external circuit.

In addition, the present invention provides a booster method for increasing the performance of an air source heat pump system at low ambient air temperatures, the air source heat pump system including a conduit system for forwarding a refrigerant through an external circuit exposed to ambient air, the booster method comprising: providing a booster chamber having chamber walls comprising thin plates of highly heat conductive material enclosing a chamber volume for containing a liquid heat exchange medium; exposing the chamber walls to ambient air; placing a tubular system within the booster chamber, with the tubular system immersed in liquid heat exchange medium contained within the booster chamber; receiving refrigerant from the conduit system at an inlet to the tubular system; advancing the refrigerant received at the inlet, through the tubular system to an outlet of the tubular system; and delivering to the conduit system refrigerant from the outlet; whereby heat passing from ambient air through the chamber walls and into the liquid heat exchange medium in the booster chamber is transferred from the liquid heat exchange medium to the refrigerant in the tubular system, to increase the temperature of the refrigerant being delivered to the conduit system and forwarded to the external circuit.

The present invention will be understood more fully, while still further objects and advantages will become available, in the following detailed description of preferred embodiments of the invention illustrated in the accompanying drawing, in which.

Figure 1:
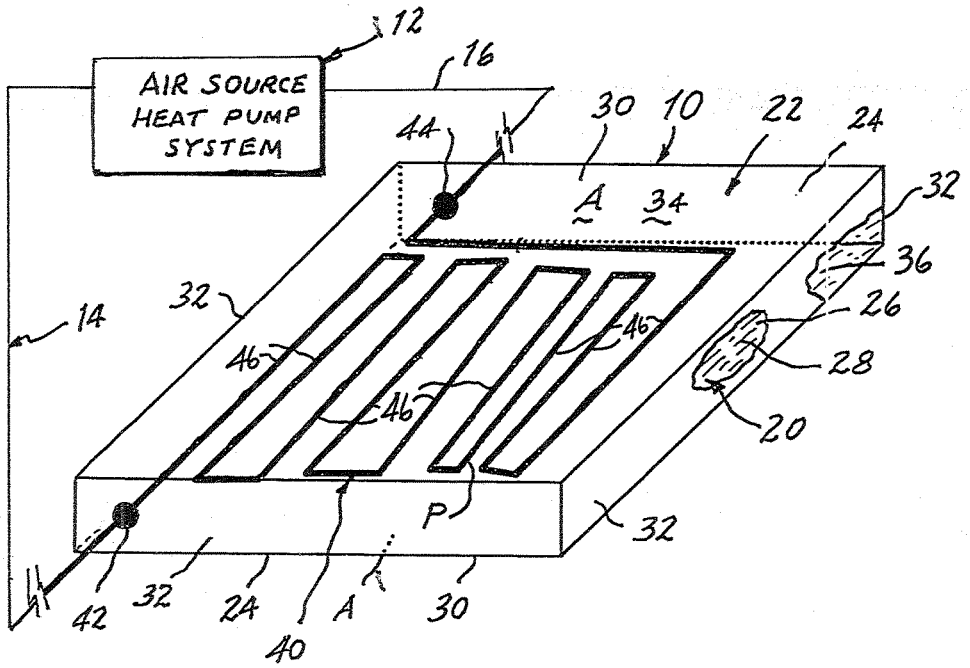
FIG. 1 is a largely schematic diagram showing an apparatus constructed in accordance with the present invention and being operated in accordance with a method of the present invention.

Referring now to the drawing, and especially to FIG. 1 thereof, an apparatus constructed in accordance with the present invention is shown in the form of a booster unit 10 being operated in connection with an air source heat pump system 12 having a conduit system 14 for circulating a refrigerant through an external circuit 16 exposed to ambient air. Booster unit 10 includes a booster chamber 20 having chamber walls 22 in the form of thin plates 24 constructed of a highly heat conductive material such as, for example, aluminum Chamber walls 22 enclose a chamber volume 26 for containing a liquid heat exchange medium 28, in the form of water or antifreeze. Chamber walls 22 include opposite walls 30 extending over a very large area A, with opposite walls 30 connected by side walls 32 of limited dimensions providing a limited distance between the opposite walls 30. Thus, area A presents very large exterior surfaces 34 along the exterior of booster chamber 20, together with very large interior surfaces 36 within the booster chamber 20, contiguous with liquid heat exchange medium 28, with the large surfaces 34 and 36 spaced apart by the limited distance provided by side walls 32. A tubular system 40 is placed within booster chamber 20 for immersion in liquid heat exchange medium 28 contained within chamber 20. Tubular system 40 includes an inlet 42 for receiving refrigerant from conduit system 12, an outlet 44 for returning the refrigerant to the conduit system 12 and a plurality of branches 46 following a serpentine path P between the inlet 42 and the outlet 44, thereby providing an extended exposure of the refrigerant to the temperature provided by the liquid heat exchange medium 28 within booster chamber 20.

Booster unit 10 is placed in ambient air so that the very large surface areas A are exposed to ambient air. The thin chamber walls 22 facilitate the conduction of heat, by virtue of being thin relative to the dimensions of the extended surface area of surfaces 34 and 36, as depicted at A in FIG. 1, from the ambient air to the contiguous heat exchange medium 28 within chamber 20, enable a rapid heat equilibrium between the ambient air and the heat exchange medium 28, with little accumulation of heat within the chamber walls 22 themselves. Heat is accumulated within the heat exchange medium 28 and is transferred rapidly, by both conduction and convection, to the refrigerant in tubular system 40, thereby increasing the temperature of the refrigerant being returned to the conduit system 14 and forwarded by the conduit system 14 to the external circuit 16. This two-step heat exchange, namely, between ambient air and the heat exchange medium 28 within chamber 20, and between the heat exchange medium 28 and the refrigerant within tubular system 40, during operation of air source heat pump system 12, accomplishes an increase in the surface temperature of surfaces of the various components of the air source heat pump system 12 within external circuit 16 exposed to ambient air, with a concomitant reduction or even elimination of the need for defrosting at those surfaces.

Figure 2:
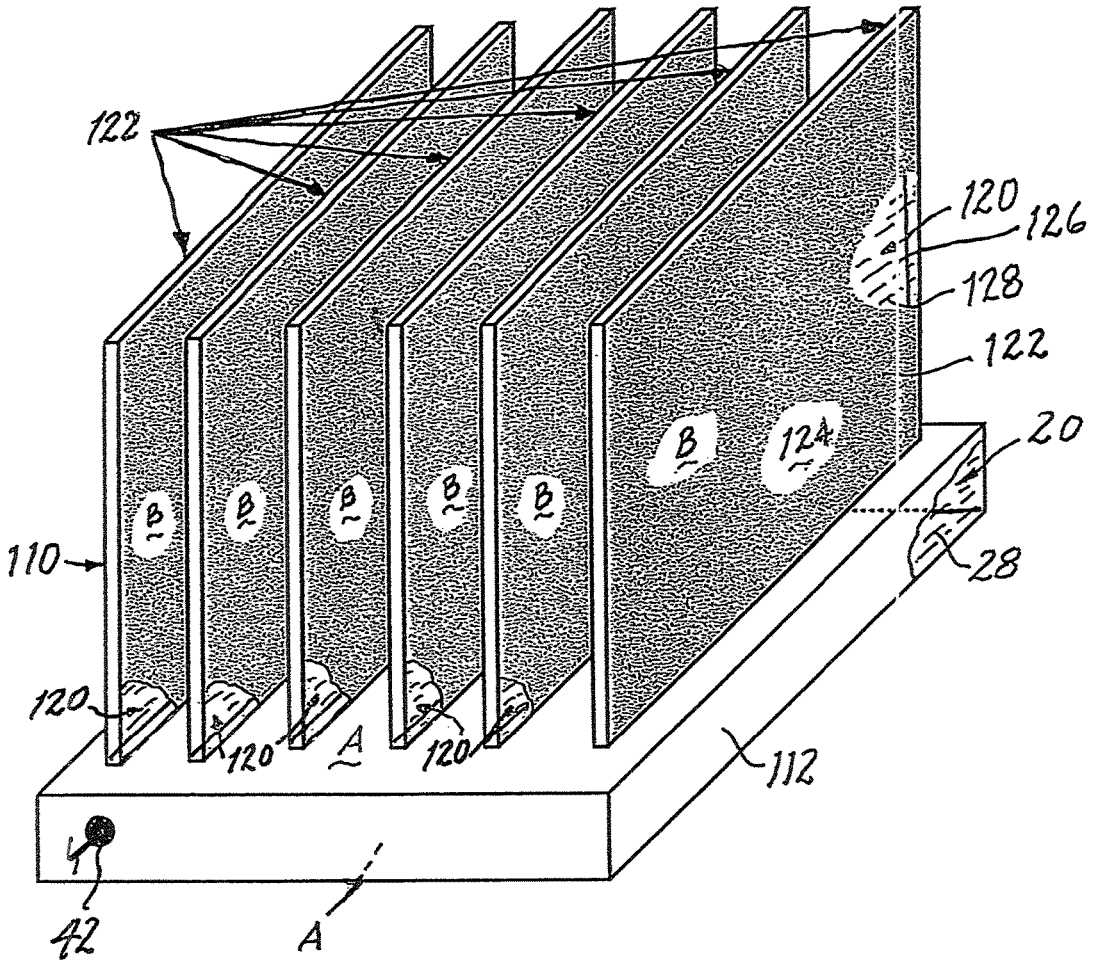
FIG. 2 is a largely schematic diagram showing another embodiment constructed and being operated in accordance with the present invention.

In the embodiment illustrated in FIG. 2, a booster unit 110 incorporates booster chamber 20 as a base chamber 112 and supplements chamber 20 with a plurality of sub-chambers 120 extending transverse to chamber 20, spaced apart from one-another and communicating with chamber 20. Each sub-chamber 120 includes sub-chamber walls 122 constructed of thin plates 124 of highly heat conducting material enclosing a corresponding sub-chamber volume 126 for containing a further volume 128 of heat exchange medium 28. Sub-chamber walls 122 provide multiple very large extended surface areas B, as compared to the thickness of plates 124 of sub-chamber walls 122, which surface areas B, when added to surface areas A, establish increased, extended areas for the transfer of heat from ambient air to the heat exchange medium 28 within booster unit 110. In the preferred arrangement, sub-chambers 120 extend upwardly, in a vertical direction, from chamber 20, substantially perpendicular to chamber 20 and essentially parallel to one-another, allowing circulation of the heat exchange medium 28 within booster unit 110 and a concomitant rapid distribution of heat for transfer from ambient air to the liquid heat exchange medium 28, and then from the liquid heat exchange medium 28 to the refrigerant within the tubular system 40 placed in chamber 20, in the manner illustrated in FIG. 1.

Figure 3:
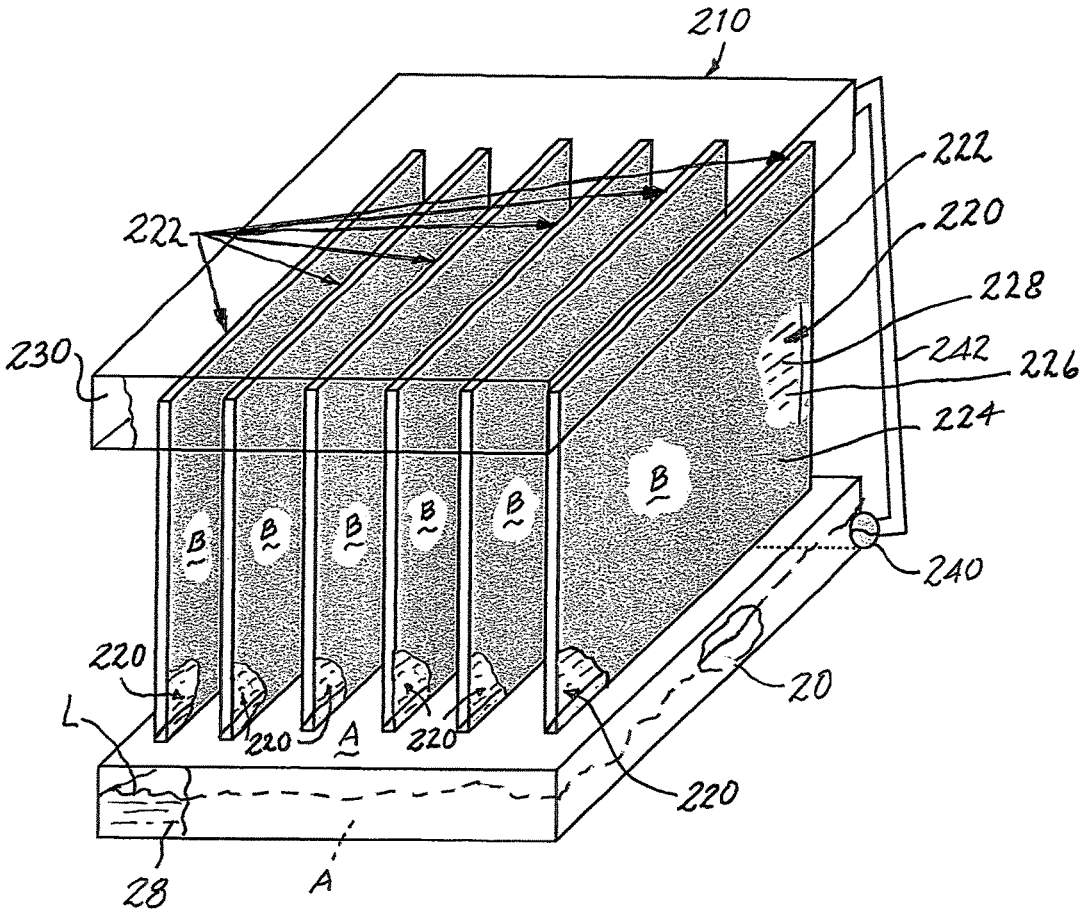
FIG. 3 is a largely schematic diagram showing still another embodiment constructed and being operated in accordance with the present invention.

In the embodiment illustrated in FIG. 3, a booster unit 210 incorporates booster chamber 20 as a base chamber, and supplements chamber 20 with a plurality of sub-chambers 220 extending upwardly from chamber 20 to a header chamber 230, the sub-chambers being spaced apart from one-another and communicating with both chamber 20 and header chamber 230. Each sub-chamber 220 includes sub-chamber walls 222 constructed of thin plates 224 of highly heat conductive material enclosing a corresponding sub-chamber volume 226 for accommodating a further volume 228 of heat exchange medium 28. Sub-chamber walls 222 provide multiple, very large surface areas B which, when added to surface areas A, establish increased areas for the transfer of heat from ambient air to the heat exchange medium 28 within booster unit 210. In the preferred arrangement, sub-chambers 220 extend upwardly, in a vertical direction, from chamber 20, substantially perpendicular to chamber 20 and essentially parallel to one-another, allowing circulation of the heat exchange medium 28 within booster unit 210 and a concomitant rapid distribution of heat for transfer from ambient air to liquid heat exchange medium 28, then from the liquid heat exchange medium 28 to the refrigerant within the tubular system 40 placed in chamber 20, in the manner illustrated in FIG. 1.

A circulation pump 240 communicates with chamber 20 and, through passage 242, with header chamber 230. During operation of the air source heat pump system in which booster unit 210 is installed (see FIG. 5, for example), heat exchange medium 28 is drawn from chamber 20 and passed to header chamber 230, through passage 242. The heat exchange medium 28 is allowed to spread through header chamber 230 and then is returned to chamber 20 through sub-chambers 220. In this manner, the transfer of heat from surrounding ambient air to heat exchange medium 28 is enhanced. The arrangement enables the volume of heat exchange medium 28 to be minimized, as indicated by the level L of heat exchange medium 28 maintained in chamber 20, for enhanced effectiveness.

Figure 4:
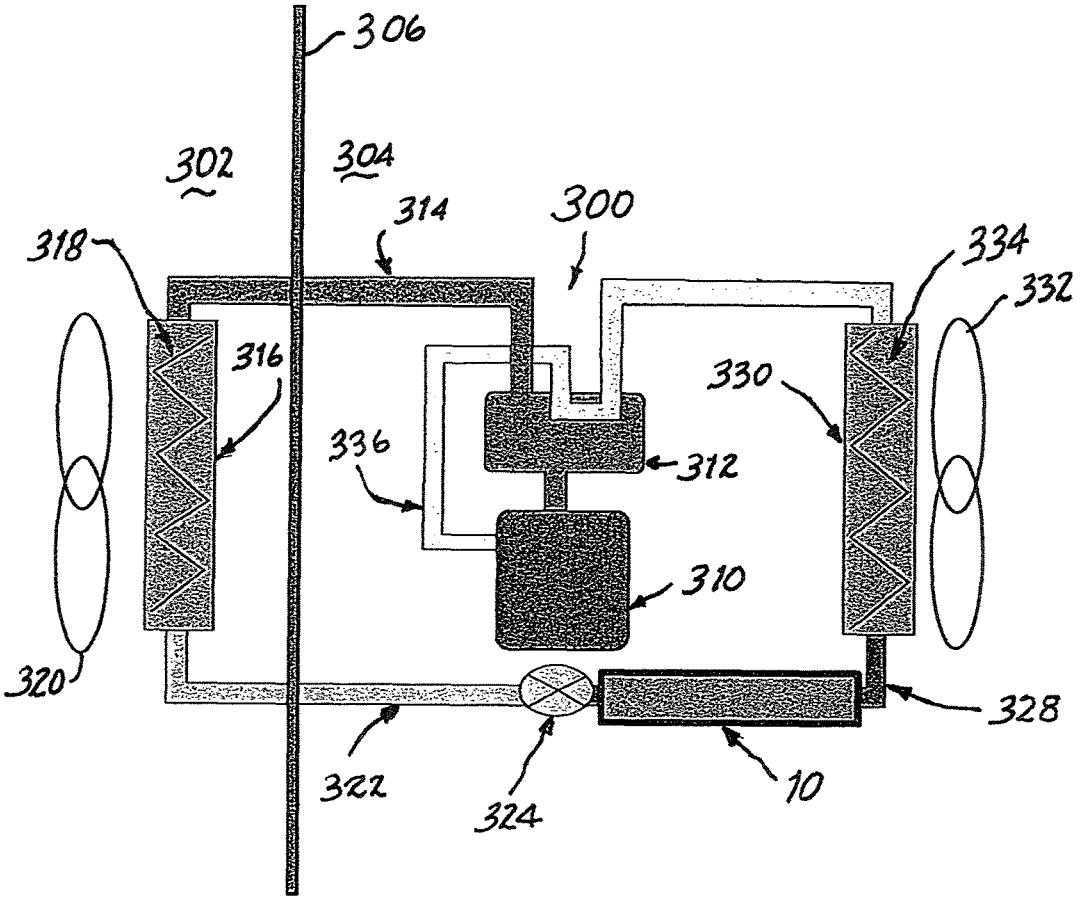
FIG. 4 is a largely schematic diagram showing an air source heat pump system incorporating an apparatus constructed and being operated in accordance with the present invention.

With reference now to FIG. 4, an air source heat pump system is shown schematically at 300 in an installation wherein heat is exchanged between an interior 302 and an exterior 304 separated from the interior 302 by a wall 306. In a heating mode, compressed refrigerant is passed from a compressor 310, through solenoid tubing 312 to a passage 314 leading to heat exchanger 316 having a finned construct 318, and a fan 320 drives air across the heat exchanger 316 for delivering heat to the interior 302. Upon releasing heat from the refrigerant, liquid refrigerant is conducted through further passage 322 to capillary tubing 324 and then to booster unit 10 where the refrigerant is preconditioned to exhibit a high saturation temperature. The preconditioned refrigerant enters an external circuit 328 which includes an external heat exchanger 330 where ambient air is driven, by a fan 332, across the heat exchanger 330 having a finned construct 334 for facilitating heat exchange. In this manner, the superheat of the refrigerant delivered to external circuit 328 is rendered higher than the dew point temperature of the ambient air, thereby precluding frosting along the external circuit 328 while increasing performance of the air source heat pump system 300. Vaporized refrigerant then is returned to compressor 310, via further tubing 336, for repeating the aforesaid cycle of operation.

Figure 5:
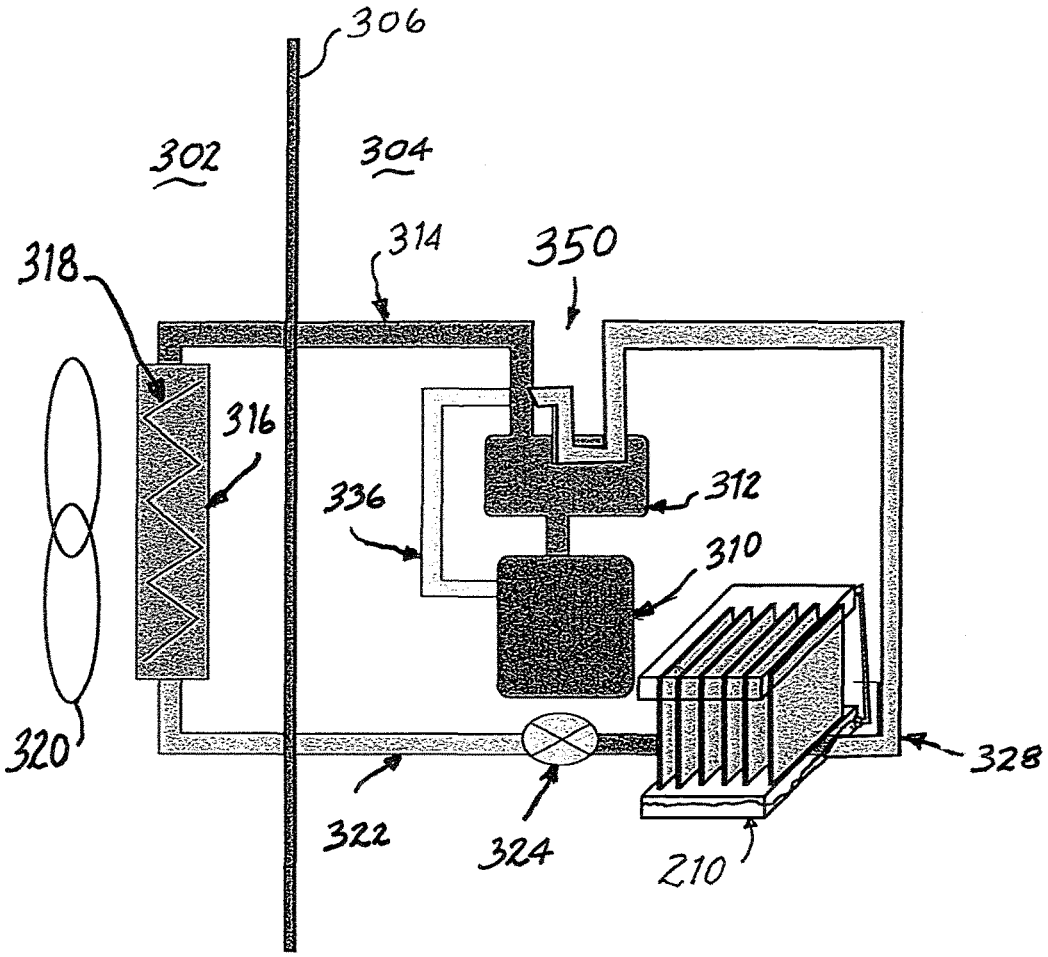
FIG. 5 is a largely schematic diagram showing another air source heat pump system incorporating an apparatus constructed and being operated in accordance with the present invention.

Turning now to FIG. 5, another air source heat pump system is shown schematically at 350 in an installation similar to that illustrated in FIG. 4 wherein heat is exchanged between an interior 302 and an exterior 304, separated from the interior 302 by a wall 306. Air source heat pump system 350 is similar to air source heat pump system 300, and operates in a similar manner, with the exception that external heat exchanger 330 of system 300 has been eliminated in favor of a booster unit constructed in accordance with the present invention, here shown as booster unit 210. All of the remaining components operate in the manner described above in connection with air source heat pump system 300 and each such component is labeled in FIG. 5 with the same reference character found in FIG. 4.

Thus, in a heating mode, compressed refrigerant is passed from compressor 310, through solenoid tubing 312 to a passage 314 leading to heat exchanger 316 where fan 318 drives air across the heat exchanger 316, having finned construct 320, for delivering heat to the interior 302. Upon releasing heat from the refrigerant, liquid refrigerant is conducted through further passage 322 to capillary tubing 324, and then to booster unit 210 where the temperature of the refrigerant is increased, as described above. In this manner, the temperature of the refrigerant delivered to external circuit 328 is rendered higher than the dew point temperature of the ambient air, thereby precluding frosting while increasing performance of the air source heat pump system 350.

Figure 6:
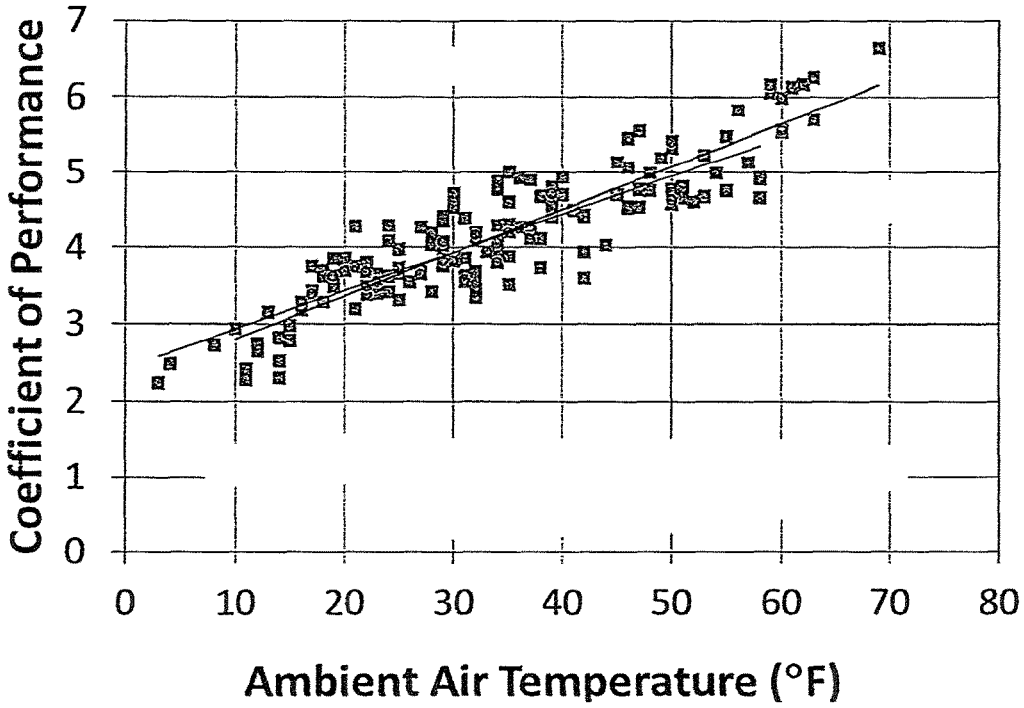
FIG. 6 is a graph depicting measurements of the performance of an apparatus in the system of FIG. 5.

Referring now to FIG. 6, a graph illustrates the results of a two-year test study of a booster unit constructed in accordance with the present invention installed in an air source heat pump system, as described above in connection with FIG. 5, with a Heating Seasonal Performance Factor (HSPF) of 9.0 and a Coefficient of Performance (COP) of about 2.7. Thus, an integrated system constructed as described in connection with FIG. 5 demonstrated linear ambient air temperature dependent performance having a low value of about 2 at 0° F. and a high value of about 6 at 60° to 70° F. The COP at 47° F. is shown to be about 4.8, representing a 70% increase in performance. Accordingly, a conventional air source heat pump system incorporating a booster unit constructed in accordance with the present invention demonstrated a significant increase in performance with a minimum defrosting requirement.

It will be seen that the present invention attains all of the objects and advantages outlined above.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A booster unit for increasing the performance of an air source heat pump system operated at low ambient air temperatures, the air source heat pump system including a conduit system for forwarding a refrigerant through an interior circuit having an internal heat exchanger wherein heat is transferred between an interior and the refrigerant and an external circuit through which external circuit the refrigerant is moved by a compressor, the external circuit extending through an exterior such that the external circuit is exposed to ambient air at the low ambient air temperatures, the booster unit comprising:

a booster chamber placed within the external circuit, between the interior circuit and the compressor, the booster chamber having chamber walls for exposure to exterior ambient air at low ambient air temperature, the chamber walls comprising plates of heat conductive material enclosing a chamber volume for containing a liquid heat exchange medium; and a tubular system placed within the booster chamber for being immersed in liquid heat exchange medium contained within the booster chamber, the tubular system including an internal circuit having a plurality of branches following a serpentine path between an inlet for receiving refrigerant from the conduit system and an outlet for delivering to the conduit system refrigerant received at the inlet and advanced to the outlet; whereby heat passing from ambient air through the chamber walls and into the liquid heat exchange medium in the booster chamber is transferred from the liquid heat exchange medium to the refrigerant in the tubular system, to increase the temperature of the refrigerant being delivered to the conduit system and forwarded to the external circuit and thereby reducing or eliminating frosting at the external circuit.

2. The booster unit of claim 1 wherein the liquid heat exchange medium is water.

3. The booster unit of claim 1 wherein the liquid heat exchange medium is antifreeze.

4. The booster unit of claim 1 wherein the plates each extend over an extended area contiguous with the chamber volume and the plates are thin relative to the extended area of the plates.

5. The booster unit of claim 4 wherein the booster chamber comprises a base chamber and the booster unit includes a plurality of sub-chambers extending transverse to the base chamber, the sub-changers being spaced apart from one-another and communicating with the base chamber, each sub-chamber having sub-chamber walls for exposure to ambient air at low ambient air temperatures, the sub-chamber walls comprising further plates of heat conductive material enclosing a corresponding sub-chamber volume for containing a further volume of the liquid heat exchange medium, the further plates each extending over a further extended area contiguous with a corresponding contained further volume and being thin relative to the extended area of the plates.

6. The booster unit of claim 5 wherein each sub-chamber extends from a first end adjacent the base chamber to a second end remote from the base chamber, and the booster unit includes a header chamber communicating with each sub-chamber adjacent the second end of each corresponding sub-chamber, the header chamber having header walls for exposure to ambient air at low ambient air temperatures, the header walls comprising thin plates of heat conductive material enclosing a corresponding header chamber volume for containing a still further volume of the liquid heat exchange medium.

7. The booster unit of claim 6 wherein the header chamber is elevated above the base chamber and the sub-chambers extend in a vertical direction, essentially parallel to one-another, between the base chamber and the header chamber.

8. The booster unit of claim 7 including a circulation pump communicating with the base chamber and with the header chamber for effecting a circulation of liquid heat exchange medium through the base chamber, the sub-chambers and the header chamber.

9. The booster unit of claim 8 wherein the liquid heat exchange medium is water.

10. The booster unit of claim 8 wherein the liquid heat exchange medium is antifreeze.

11. A booster method for increasing the performance of an air source heat pump system operated at low ambient air temperatures, the air source heat pump system including a conduit system for forwarding a refrigerant through an interior circuit having an internal heat exchanger wherein heat is transferred between an interior and the refrigerant and an external circuit through which external circuit the refrigerant is moved by a compressor, the external circuit extending through an exterior such that the external circuit is exposed to ambient air at the low ambient air temperatures, the booster method comprising:

placing a booster chamber within the external circuit, between the interior circuit and the compressor, the booster chamber being provided with chamber walls comprising plates of heat conductive material enclosing a chamber volume containing a liquid heat exchange medium;

exposing the chamber walls to exterior ambient air at low ambient air temperatures;

placing a tubular system within the booster chamber, with the tubular system having a plurality of branches following a serpentine path immersed in liquid heat exchange medium contained within the booster chamber;

receiving refrigerant from the conduit system at an inlet to the tubular system;

advancing the refrigerant received at the inlet, along the serpentine path through the tubular system to an outlet of the tubular system; and delivering to the conduit system refrigerant from the outlet; whereby heat passing from ambient air through the chamber walls and into the liquid heat exchange medium in the booster chamber is transferred from the liquid heat exchange medium to the refrigerant in the tubular system, to increase the temperature of the refrigerant being delivered to the conduit system and forwarded to the external circuit, thereby reducing or eliminating frosting at the external circuit.

12. The method of claim 11 wherein the liquid heat exchange medium is water.

13. The method of claim 11 wherein the liquid heat exchange medium is antifreeze.

14. The booster method of claim 11 including:

providing the booster chamber in the form of a base chamber;

providing a plurality of sub-chamber extending transverse to the base chamber, spaced apart from one-another and communicating with the base chamber;

providing each sub-chamber with sub-chamber walls comprising thin plates of heat conductive material enclosing a corresponding sub-chamber volume;

containing a further volume of the liquid heat exchange medium within each sub-chamber volume; and exposing the sub-chamber walls to ambient air at low ambient air temperatures.

15. The booster method of claim 14 including:

extending each sub-chamber from a first end adjacent the base chamber to a second end remote from the base chamber;

providing a header chamber communicating with each sub-chamber adjacent the second end of each corresponding sub-chamber, the header chamber having header walls comprising further plates of heat conductive material enclosing a corresponding header chamber volume;

containing a still further volume of the liquid heat exchange medium within the header chamber volume; and exposing the header walls to ambient air at low ambient air temperatures.

16. The booster method of claim 15 including:

elevating the header chamber above the base chamber; and extending the sub-chambers in a vertical direction, essentially parallel to one-another, between the base chamber and the header chamber.

17. The booster method of claim 16 including circulating liquid heat exchange medium through the base chamber, the sub-chambers and the header chamber.

18. The booster method of claim 17 wherein the liquid heat exchange medium is water.

19. The booster method of claim 17 wherein the liquid heat exchange medium is antifreeze.

20. The booster method of claim 11 including extending the plates over an extended area contiguous with the chamber volume, the plates being thin relative to the extended area of the plates.

* * * * *